United States Patent [19]

Ozbey et al.

[11] 4,170,351

[45] Oct. 9, 1979

[54] SPRING-TYPE ARM AND LEG EXERCISER

[76] Inventors: Ahmet M. Ozbey; Amber L. Ozbey, both of 205 Bonhill Dr., Ft. Washington, Md. 20022

[21] Appl. No.: 840,091

[22] Filed: Oct. 6, 1977

[51] Int. Cl.[2] ..... A63B 21/00; A63B 23/04

[52] U.S. Cl. ..... 272/134; 272/143; 272/DIG. 4; 272/135; 272/136; 272/132

[58] Field of Search ..... 272/137, 138, 143, 144, 272/DIG. 4, 76, 77, 78, 72, 67, 135, 146, 132, 134, 136; 128/25 R, 25 B, 26, 363, 364

[56] References Cited

U.S. PATENT DOCUMENTS

| | | | |
|---|---|---|---|
| 693,701 | 2/1902 | Gossman | 272/72 |
| 1,176,365 | 5/1916 | Hartnett | 128/25 R |
| 1,721,709 | 7/1929 | Odell | 272/144 |
| 1,902,694 | 3/1933 | Edwards | 272/144 X |
| 2,924,456 | 2/1960 | Miller | 272/144 X |
| 3,912,264 | 10/1975 | Busse et al. | 272/72 |
| 3,976,058 | 8/1976 | Tidwell | 272/144 X |
| 4,089,520 | 5/1978 | Ozbey et al. | 272/44 X |

FOREIGN PATENT DOCUMENTS

| | | | |
|---|---|---|---|
| 88141 | 10/1907 | Switzerland | 272/72 |
| 161588 | 2/1931 | Switzerland | 272/72 |

*Primary Examiner*—Richard C. Pinkham
*Assistant Examiner*—William R. Browne
*Attorney, Agent, or Firm*—Sixbey, Friedman & Leedom

[57] ABSTRACT

The exercise device is adapted to simultaneously exercise all of the limbs of a human being by subjecting them to the combined tensions induced by gravity in combination with mechanical spring bias. Both the arms and legs of a user are caused to move about a universal pivot against spring tension while being held outstretched and subjected to the force of gravity. Pivotal arm exercise frames are provided which are adjustable to accommodate various human arm lengths and also angularly adjustable to subject the arms of an exerciser to different stresses. Similarly, a leg exercise assembly is provided which is adaptable for persons of varying heights and leg lengths and which is angularly adjustable relative to a vertical plane to vary the abdominal tension experienced by a user.

16 Claims, 4 Drawing Figures

SPRING-TYPE ARM AND LEG EXERCISER

BACKGROUND OF THE INVENTION

Recent emphasis on health and physical fitness has resulted in a demand for improved exercise equipment for home and office use. Most known exercise equipment has been designed for gymnasium use where a large quantity of space is generally available, and consequently elaborate mechanisms for separately exercising each limb of the human body have been developed. There include wall mounted systems consisting of cables, springs, pulleys and weights for exercising the arms, while elaborate bicycle type mechanisms have been developed to build leg muscles. From these a user can move on to special inclined ramps and similar devices for abdominal muscle building.

The home exercise practitioner, who has neither the space nor the capital investment necessary to accommodate complex and bulky gymnasium equipment, generally must make do with small, simple spring devices for separately exercising the arms, hands and legs. More commonly, those exercising at home operate without the benefit of any equipment and engage in arm and leg exercises performed from a prone position. Many of these exercises utilize the forces supplied by gravity as a muscle building factor.

There is a tremendous need for home exercise equipment which is simple compact and inexpensive, and which is designed so that a single unit will effectively exercise all body appendages as well as the abdomen and back.

SUMMARY OF THE INVENTION

The exercise device of the present invention consists of a support for the entire body of a user which pivotally mounts two laterally extending arm exercise frames. These arm exercise frames may be angularly adjusted relative to a horizontal plane to positions both above and below such plane, and each arm exercise frame mounts a spring tensioned exercise unit adapted for movement about a universal pivot point. The support platform also mounts a pivotable leg and abdominal exerciser which is angularly adjustable relative to a vertical plane.

It is the primary object of the present invention to provide a novel and improved exercise device which employs the tension imparted by a combination of gravity and spring bias to exercise simultaneously the arms, legs, abdomen and back of a user.

Another object of the present invention is to provide a novel and improved exercise device which is compact and inexpensive and consequently is adapted for home use.

A further object of the present invention is to provide a novel and improved exercise device which is both adjustable to adapt the unit for use with persons of varying heights and limb lenghts while also being adjustable to vary the positions in which the limbs are exercised and thus the tension applied to the body.

A still further object of the present invention is to provide a novel and improved exercise device upon which a user may lie to perform conventional exercises unassisted by the device in conjunction with exercises performed with the device.

These and other objects of the present invention will become readily apparent from a consideration of the following specification and claims taken in conjunction with the accompanying drawings.

DRAWINGS

DETAILED DESCRIPTION OF THE DRAWINGS

Figure 1:
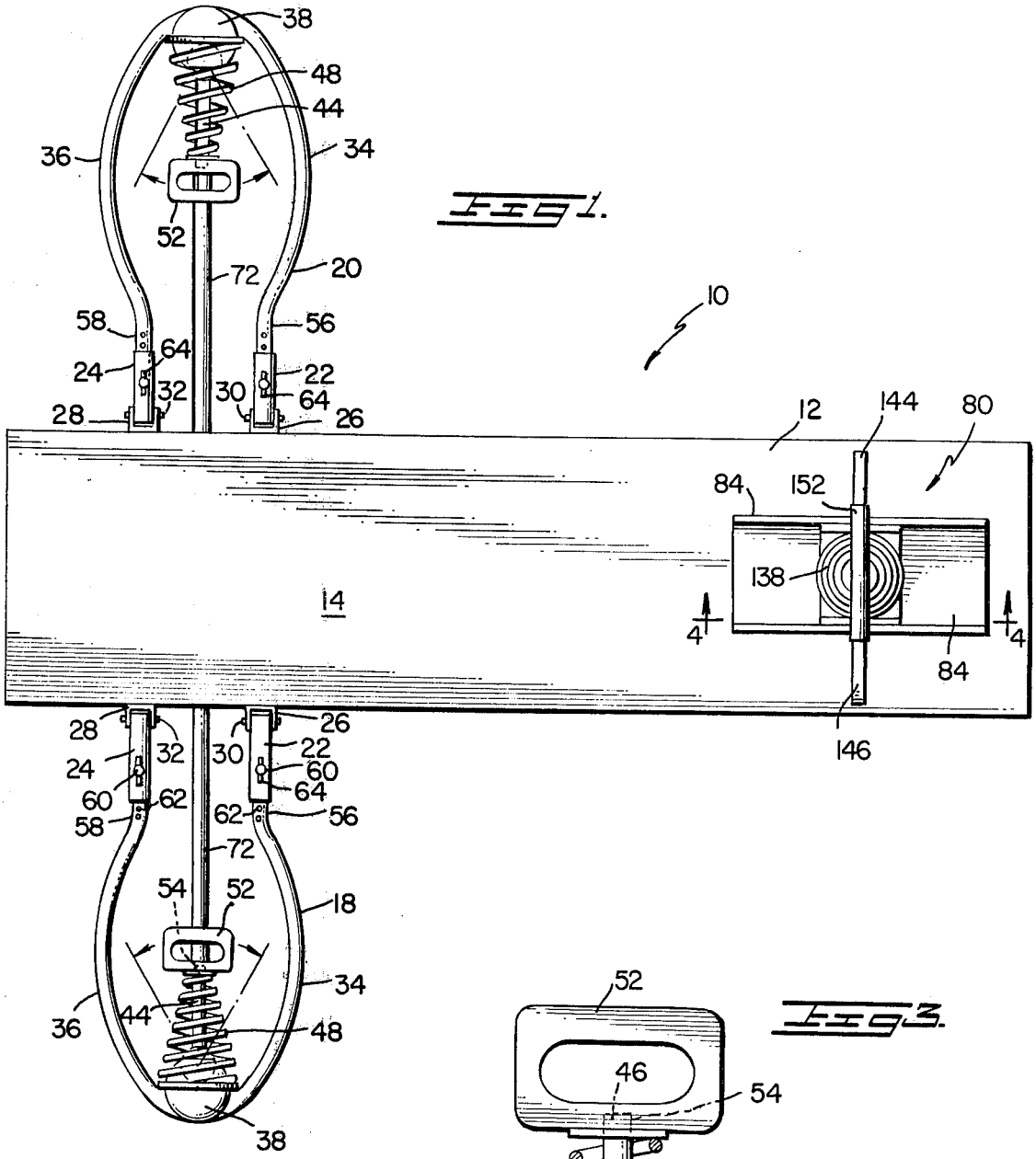
FIG. 1 is a plan view of the exercise device of the present invention.

Referring now to the drawings, the exercise device of the present invention indicated generally at 10 includes an elongated rectangular support 12 which is formed of rigid material of sufficient strength to support a human body. The upper surface of the support 12 indicated at 14 may be padded by a foam rubber mat or similar padding material to provide cushioning for a person reclining on the support. Conceivably, the support 12 could be placed upon a table or other suitable structure which would mount the support above a floor, but ideally, the support is provided with suitable leg members 16. These leg members furnish a very rigid base for the support so that a person lying prone thereon may exercise in comfort and safety.

Extending laterally from either side of the support 12 are arm exercise frames 18 and 20. Since these frames are identical in configuration, the structure of one will be described in detail and like reference numerals applied to both. Each arm exercise frame is formed from tubular metal material shaped to provide a wing shaped frame terminating in two substantially parallel, spaced end sections 22 and 24. These end sections are pivotally mounted within two spaced brackets 26 and 28 mounted on the support 12 by suitable pivot pins 30 and 32. Pivot pins 30 and 32 mount the arm exercise frames for pivotal movement about a horizontal axis so that the frames may be angularly adjusted relative to a horizontal plane. Thus, as viewed in FIG. 1, the arm exercise frames 18 and 20 may be pivoted to angular positions both above and below the horizontal plane of the support 12.

The arm exercise frames 18 and 20 may be formed to any suitable shape which will permit extensive rotative movement of the arms of a person supported upon the support 12 within the confines of the arm exercise frame. In FIG. 1, the arm exercise frame outboard of the end sections 22 and 24 is bowed outwardly at 34 and 36 to provide for more extensive movement of the outer extermities of a human arm, and then converged inwardly to form a loop or bridge at the outermost extremity of the exercise frame. Supported by this outermost loop or bridge is a ball and socket joint 38 (FIG. 3) having a socket 40 which supports a ball 42. This is a conventional ball and socket joint wherein the ball rotates within the socket to provide substantially universal movement in all directions.

A shaft 44 having a threaded end 46 is connected to the ball 42 and projects upwardly from the center thereof. Coiled about this shaft is a heavy compression spring 48 having one end seated adjacent the socket 40 on a seat 50. Alternatively, the end of the spring may slip into a receiver which is formed on the socket housing and is adapted to releasably hold the end of the spring.

The spring 48 is maintained on the shaft 44 by a handle 52 having a threaded socket 54 provided therein to cooperate with the threads 46 on the end of the shaft. With the handle 52 threaded in place on the shaft 44, the spring 48 will be locked about the shaft. The handle may be removed to add stronger or weaker springs to the shaft.

The spring 48 is a heavy tapered coil spring which opposes the universal movement of the shaft 44 provided by the ball and socket joint 38 due to the end connection of the spring to the socket 40. In its normal position, the shaft 44 extends inwardly from the end of the arm exercise frames 18 and 20 toward the platform 12. The spring normally maintains the shaft in substantially the same plane as the arm exercise frame.

In some instances the shaft 44 and ball and socket joint 36 could be eliminated and the handle 52 would then be connected to the end of the spring 48 which would be secured by its remaining end to the arm exercise frame. This structure would not have the strength possessed by the structure of FIG. 3.

To permit adjustment of the arm exercise frames 18 and 20 to accommodate different arm lengths, the end sections 22 and 24 thereof are designed to telescope with cooperating sections 56 and 58 in the frame. Both the end sections 22 and 24 and the sections 56 and 58 are provided with aligned holes 60 and 62 respectively so that the two sections may be locked in an adjusted position by set screws 64. Thus the outer sections of each arm exercise frame may be moved toward or away from the platform 12 within the end sections 22 and 24 until an adjusted position for a desired arm length is reached. At this point holes 60 and 62 are aligned at a point closest to this desired position and the frame is then locked by inserting the set screws through these holes to be locked in place with wing nuts.

To permit the arm exercise frames 18 and 20 to be maintained in an angularly adjusted position relative to the horizontal, a tubular support bar 66 is hinged to the underside of each frame beneath the ball and socket joint 38. A suitable hinge structure may be provided at 68 which will permit relative movement about a horizontal axis between the support bar 66 and the arm exercise frame as the frame is moved upwardly or downwardly about the pivots 30 and 32.

The free end of the support bar 66 receives one end of a tube 70, the remaining end of the tube being pivoted at 72 to one of the legs 16. The tube 70 is provided with adjustment holes 74 which align with a hole 76 in the support 66. Thus, the support 66 may be moved upwardly or downwardly relative to the tube 70 until a desired angular position of the arm exercise frame is achieved. At this point, the two are locked together by inserting a bolt 78 through aligned holes 74 and 76 and securing the bolt with a wing nut. This positively locks the support 66 to the tube 70 to form a very rigid support for the arm exercise frame attached thereto. Thus it may be seen that the arm exercise frames can be positioned to extend outwardly from the support 12 in substantially the same plane as the support, or alternatively the arm exercise frames may be adjusted to extend angularly upwardly or downwardly from the support 12.

Figure 2:
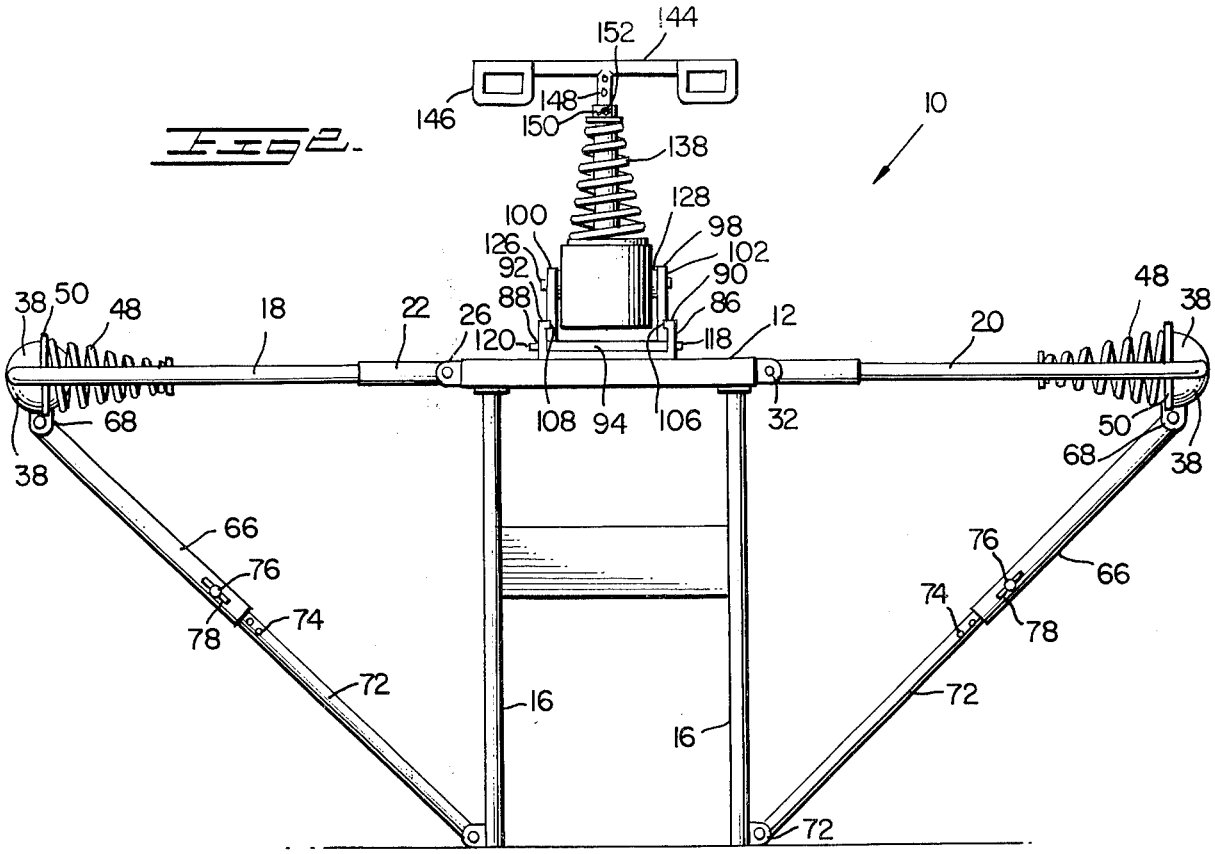
FIG. 2 is an end view of the exercise device of FIG. 1.
Figure 4:
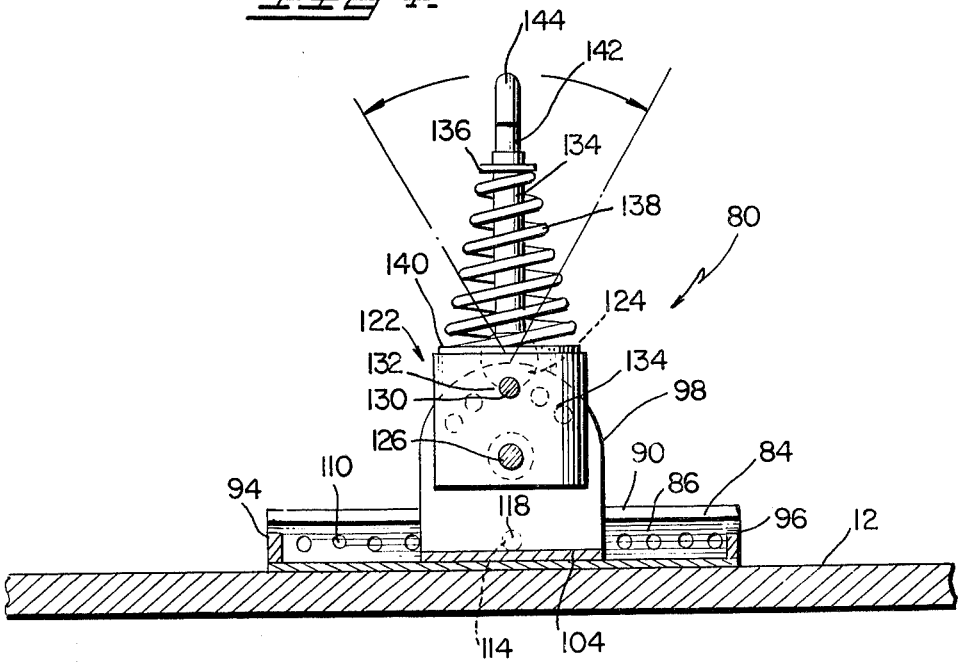
FIG. 4 is a sectional view taken along lines 4—4 of FIG. 1.

Projecting upwardly from the support 12 at a substantially central position on the support and spaced from the laterally extending arm exercise frames 18 and 20 is a leg and abdomen exercise assembly indicated generally at 80. This assembly includes a track unit 84 positioned longitudinally of the support 12 and secured thereto. This track unit includes vertically extending, spaced parallel side tracks 86 and 88 having inwardly projecting flanges 90 and 92 respectively formed at the upper edges thereof (FIG. 2). The ends of the spaced track members 86 and 88 are bridged by stop units 94 and 96 which prevent an assembly confined by the tracks from leaving the tracks at the ends thereof.

A U-shaped mount 98 having spaced sidewalls 100 and 102 joined by a bottom wall 104 is mounted for sliding movement within the track 84. The sidewalls 100 and 102 are provided with slots 106 and 108 respectively to receive the flanges 90 and 92. To lock the U-shaped mount in an adjusted position, each of the track members 86 and 88 is provided with a plurality of longitudinally spaced apertures 110 which extend therethrough and align with apertures 114 in the sidewalls 100 and 102 of the U-shaped mount. To lock the U-shaped mount to the track members, pins or screws 118 and 120 are inserted through the apertures 110 into the apertures 114.

The U-shaped mount 98 pivotally supports a socket assembly 122 which cooperates with a ball joint 124 to provide a ball and socket assembly. The socket assembly 122 pivots about a pivot pin 126 extending through the sidewalls 100 and 102 of the U-shaped mount. Suitable antifriction bushings 128 may be positioned around the pivot pin 126 between the socket assembly and the U-shaped mount. The socket assembly pivots about the pivot pin 126 to different angular positions with respect to the vertical. To hold the socket assembly in a desired angular position, a spring pressed pin 130 is mounted within the socket assembly so as to be biased outwardly by an internal spring (not shown). This spring pressed pin may be selectively inserted in one of a plurality of apertures 134 extending through the sidewall 100 of the U-shaped mount 98.

Figure 3:
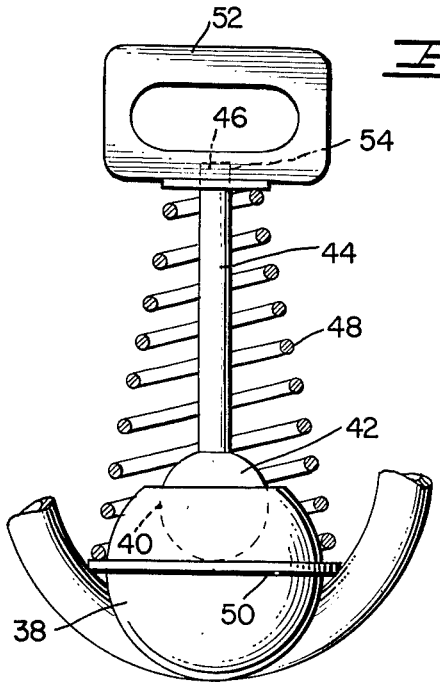
FIG. 3 is a plan view of the spring biased arm exercising mechanism for the exercise device of FIG. 1.

The socket assembly 122 cooperates with the ball 124 to provide a ball and socket joint very similar to the ball and socket joint 38 of FIG. 3. Extending upwardly from the center of the ball is a tubular shaft 134 which terminates in an end surrounded by an annular flange 136. This flange is threaded onto the end of the shaft 134 and may be removed to facilitate the replacement of a compression spring 138 which surrounds the shaft. This spring is held onto the shaft by the flange 136, and extends about the shaft in the same manner as the spring 48 extends about the shaft 44. The lower end of the spring 138 is mounted on the socket assembly 122 by a seat 140 formed on the socket assembly. Thus the spring opposes movement of the shaft 134 and ball 124 relative to the socket assembly.

Spring 138, like the spring 48, is an extremely strong compression spring, and consequently it requires an appreciable force to move the shaft 134. Also, like the spring 48, the spring 138 may be removably connected to the assembly 122.

Inserted in the upper end of the shaft 134 in telescoping relationship therewith is a second shaft 142 having a cross bar 144 secured at the upper end thereof to form a T-shaped structure. Loops 146 may be formed at either end of the cross bar 144 to receive the feet of an individual employing the exercise device 10. So that the cross bar may be vertically adjusted relative to the platform 14, a plurality of holes 148 in the tubular shaft 142 cooperate with a hole 152 in the shaft 134. Thus the shaft 142 may be vertically adjusted relative to the shaft 134, and when a proper vertical adjustment is achieved, a bolt 152 may be inserted through aligned holes 148 and 150 to lock the two shafts in the adjusted position. As in the case of the handles 52, the cross bar 144 could be directly connected to the assembly 122 by the spring 138 thereby eliminating the ball 124 and shaft 134.

To operate the exercise device 10, a user adjusts the arm exercise frames 18 and 20 so that while lying prone on the support 12 with arms outstretched, his hands will grasp the handles 52 without bending of the elbows or wrists. This is accomplished by adjusting sections 56 and 58 relative to the end sections 24 and 26. The angular relationship between the support and the arm exercise frames may also be adjusted by sliding support bar 66 relative to tube 70 to pivot the arm exercise frames about the pivot pins 30 and 32.

The leg and abdomen exercise assembly 80 is also adjusted to accommodate the body of the user while in the prone position. This is accomplished by longitudinally adjusting the U-shaped mount 98 along the track unit 84 and then locking the mount in the adjusted position with the pins 118 and 120. Next the angular position of the socket assembly 122 may be set by moving the socket assembly about the pivot pin 126, and the position of the cross bar 144 may be set by sliding the shaft 142 relative to the shaft 134.

Once the exercise device is adjusted, the user, lying prone on the support 12, places his feet in the loops 146 and grasps the hendles 52. Arm and shoulder exercises may be conducted by rotating the handles 52, moving the handles up and down vertically or moving the handles back and forth horizontally. Spring induced tension on the arms of an exerciser may be varied by removing the handles 52 from the shafts 44 and adding stronger or weaker springs 48. Gravity induced tension may be varied by altering the angle of the arm exercise frames relative to the support 12.

Leg exercises may be performed either separately or in conjunction with simultaneous arm exercises by using the legs to rotate the crossbar 144 or to move the crossbar back and forth along various arcs defined by movement of the ball 124 in the socket assembly 122. The spring tension of the leg and abdomen exercise assembly 80 may be varied by removing the flange 136 and replacing the spring 138 with a stronger or weaker spring. Gravity induced tension may be varied by altering the angular position of the socket assembly 122 through rotation of this assemby about the pivot pin 126.

An exerciser using the exercise device 10 may lie on either his stomach or back, and may readily combine non mechanical exercises with mechanical exercises using the exercise device. For example, conventional situps can be accomplished with the legs held in different angular positions above the support 12 by the leg and abdomen exercise assembly 80. Thus the exercise device 10 can be used to effectively accomplish an extensive exercise program involving a large number of varying exercises.

The structure of the exercise unit 10 can be modified in several ways within the purview of this inventor to accomplish the function of the invention. For example, as previously indicated, universal movement of the handle 53 about a mounting point on the arm exercise frames 18 and 20 may be achieved by connecting the handle to the frame by only the spring 48. Similarly, the cross bar 144 may be directly connected to the seat 140 by the spring 138.

It should also be noted that instead of making the arm exercise frames 18 and 20 adjustable in length, the frames might be constructed as a unitary unit. Adjustment would then be accomplished by replacing the unitary shaft 44 with an adjustable two section unit of the type provided by the shafts 134 and 142 of the leg and abdomen exercise assembly 80.

Finally, the arm exercise frames 18 and 20 could take a variety of forms which would permit adjustment and also support the exercise unit formed by the shaft 44, the spring 48 and the handle 52 in spaced relationship to both the arm exercise frame and the support 12. For example, these frames could constitute an "L" shaped support with the exercise unit being mounted upon and extending inwardly from the short leg of the "L".

I claim:

1. An exercise apparatus comprising elongated platform means for supporting the body of a user in the prone position and arm exercise means mounted on said platform means near one end thereof and at opposite sides thereof, each said arm exercise means including an arm support extending laterally from said platform means and attached thereto in a manner such that said arm support can be angularly adjusted about a pivotal axis which is substantially parallel to the longitudinal axis of said platform means, said arm exercise means also including an elongated spring exercise unit having a first end secured to said arm support at the outer end thereof, said exercise unit extending in spaced relationship to said arm support and platform means toward said platform means, and universal mounting means for securing the first end of said exercise unit for substantially universal movement about a mounting point on said arm support, said universal mounting means including biasing means to oppose movement of said exercise unit about said mounting point.

2. The exercise apparatus of claim 1 wherein said arm support includes a first section mounted on said platform means and a second section movably mounted upon said first section, said second section being movable relative to said first section to adjust the length of said arm support.

3. The exercise apparatus of claim 2 wherein said first section is mounted on said platform means for adjustment about a pivotal axis to permit angular adjustment of said arm support relative to the plane of said platform means, said exercise unit being mounted upon said second section.

4. The exercise unit of claim 1 wherein said universal mounting means includes a ball and socket joint extending between said arm support and said exercise unit, said exercise unit including an elongated shaft having one end connected to the ball of said ball and socket joint and hand grip means connected to the opposite end thereof.

5. The exercise unit of claim 4 wherein said biasing means includes a tapered compression spring mounted about said elongated shaft, the large end of said tapered compression spring being seated adjacent said ball and socket joint.

6. The exercise apparatus of claim 1 wherein a leg and abdominal exercise assembly is mounted upon said platform means in spaced relationship to said arm exercise means.

7. The exercise apparatus of claim 6 including a track assembly attached to said platform means in spaced relationship to said arm exercise means, wherein said leg and abdominal exercise assembly is movably mounted within said track assembly to facilitate adjustment of said leg and abdominal exercise assembly relative to said arm exercise means.

8. The exercise apparatus of claim 7, wherein said leg and abdominal exercise assembly includes an elongated leg exercise unit extending above said platform means and an exercise unit mounting means fastened within said track assembly, said elongated leg exercise unit having a lower end secured to said exercise unit mounting means at a mounting point which permits substantially universal movement of the upper end of said elongated leg exercise unit about said mounting point, said elongated leg exercise unit also having a leg biasing means to oppose movement of said upper end relative to said mounting point.

9. The exercise apparatus of claim 8, wherein said exercise unit mounting means operates to permit angular adjustment of said elongated leg exercise unit about a pivotal axis substantially traverse to the longitudinal axis of said platform means.

10. The exercise apparatus of claim 9, wherein said exercise unit mounting means includes a ball and socket joint, and said elongated leg exercise unit includes a first elongated shaft having one end connected to the ball of said ball and socket joint and a second elongated shaft connected in telescoping relationship with said first elongated shaft, said elongated leg exercise unit also including fast receiving means connected to said second elongated shaft.

11. The exercise apparatus of claim 1 including a leg and abdominal exercise assembly, and a track assembly attached to said platform means in spaced relationship to said arm exercise means, wherein said leg and abdominal exercise assembly is movably mounted within said track assembly to facilitate adjustment of said leg and abdominal exercise assembly relative to said arm exercise means.

12. The exercise apparatus of claim 11 wherein said leg and abdominal exercise assembly includes an elongated leg exercise unit extending above said platform means and an exercise unit mounting means fastened within said track assembly, said elongated leg exercise unit having a lower end secured to said exercise unit mounting means at a mounting point which permits substantially universal movement of the upper end of said elongated leg exercise unit about said mounting point for said lower end, said elongated leg exercise unit also having a leg biasing means to oppose movement of said upper end relative to said mounting point.

13. The exercise apparatus of claim 11 wherein said leg and abdominal exercise assembly includes an elongated leg exercise unit extending above said platform means and an exercise unit mounting means fastened within said track assembly, said exercise unit mounting means operating to permit angular adjustment of said elongated leg exercise unit about a pivotal axis substantially transverse to the longitudinal axis of said platform means.

14. The exercise apparatus of claim 1 wherein a leg and abdominal exercise assembly is mounted upon said platform means in spaced relationship to said arm exercise means, said leg and abdominal exercise assembly including an elongated leg exercise unit which is secured at a lower end to an exercise unit mounting means, said exercise unit mounting means operating to mount said leg exercise unit to permit substantially universal movement of an upper end of said leg exercise unit about a mounting point for the lower end thereof, and leg biasing means to oppose movement of said upper end relative to said mounting point.

15. The exercise apparatus of claim 14 wherein said exercise unit mounting means operates to mount said elongated leg exercise unit for movement longitudinally of said platform means to facilitate adjustment thereof relative to said arm exercise means.

16. The exercise apparatus of claim 15 wherein said exercise unit mounting means includes a ball and socket joint, said leg exercise unit including a first elongated shaft having one end connected to the ball of said ball and socket joint and a second elongated shaft connected in telescoping relationship with the free end of said first elongated shaft, and first receiving means connected to said second elongated shaft.

* * * * *